US010386770B2

(12) United States Patent
Soda

(10) Patent No.: US 10,386,770 B2
(45) Date of Patent: Aug. 20, 2019

(54) IMAGE FORMING DEVICE

(71) Applicant: KYOCERA Document Solutions Inc., Osaka-shi (JP)

(72) Inventor: Tomohisa Soda, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/214,322

(22) Filed: Dec. 10, 2018

(65) Prior Publication Data

US 2019/0187603 A1 Jun. 20, 2019

(30) Foreign Application Priority Data

Dec. 18, 2017 (JP) ..... 2017-241501

(51) Int. Cl.
*G03G 15/06* (2006.01)
*G03G 15/00* (2006.01)

(52) U.S. Cl.
CPC ..... *G03G 15/556* (2013.01)

(58) Field of Classification Search
CPC ..... G03G 15/087; G03G 15/556; G03G 15/0822; G03G 15/0862; G03G 15/0865; G03G 15/0867; G03G 15/0868; G03G 15/0872; G03G 15/0877; G03G 15/0879; G03G 2215/066; G03G 2215/0663; G03G 2215/0665; G03G 2215/0678; G03G 2215/0685
See application file for complete search history.

(56) References Cited

U.S. PATENT DOCUMENTS

2004/0052538 A1* 3/2004 Yugeta ..... G03G 15/0856 399/27
2016/0170356 A1* 6/2016 Mabuchi ..... G03G 15/55 399/27
2016/0259286 A1* 9/2016 Akiba ..... G03G 15/55
2019/0086832 A1* 3/2019 Nohara ..... G03G 15/16
2019/0086835 A1* 3/2019 Nohara ..... G03G 15/0868

FOREIGN PATENT DOCUMENTS

JP 2011-197229 10/2011
JP 2014-157350 8/2014

* cited by examiner

*Primary Examiner* — Thomas S Giampaolo, II
(74) *Attorney, Agent, or Firm* — Gerald E. Hespos; Michael J. Porco; Matthew T. Hespos

(57) ABSTRACT

An image forming device includes a developing device; a first toner container; a second toner container; a drive controller; and a consumption amount calculation portion. The drive controller switches a first replenishment state of replenishing a toner from the first toner container to the developing device and a second replenishment state of replenishing a toner from the second toner container to the developing device in response to a toner replenishment request from the developing device. The consumption amount calculation portion calculates a consumption amount of a toner in each of the first toner container and the second toner container by calculating a flow rate of each toner flowing through the first horizontal transport portion and the second horizontal transport portion.

4 Claims, 10 Drawing Sheets

IMAGE FORMING DEVICE

BACKGROUND

Field of the Invention

The present application claims priority from Japanese Patent Application No. 2017-241501 filed on Dec. 18, 2017, disclosure of which is all incorporated herein.

Field of the Invention

The present disclosure relates to an image forming device which forms an image on a sheet.

Conventional image forming devices adopting an electrophotography system, such as a printer, a copying machine, and the like, include a photosensitive drum which carries an electrostatic latent image, a developing device which supplies a toner to the photosensitive drum to make an electrostatic latent image appear as a toner image, and a transfer device which transfers a toner image to a sheet from the photosensitive drum.

Image forming devices each equipped with a plurality of developing devices according to color toners of respective colors are known, in which two toner containers are arranged for each developing device in order to supply the developing device with a replenishment toner. Even when one toner container becomes empty, a toner can be replenished from the other toner container, and thus a forced stop time (printing disable time) of the image forming device can be reduced. In particular, during the execution of a print job including a large volume of sheets to be printed, interruption of the job due to lack of toner can be suppressed.

A technique is also known for calculating a toner consumption amount of a toner container based on a rotation rate of a transport screw arranged on a transport path between the toner container and a developing device.

SUMMARY

An image forming device according to one aspect of the present disclosure includes a photosensitive drum; a developing device; a first toner container; a second toner container; a first vertical transport portion; a second vertical transport portion; a first horizontal transport portion; a second horizontal transport portion; a first transport member; a second transport member; a transport member drive portion; a container drive portion; a joining portion; a first detection sensor; a second detection sensor; a drive controller; a count portion; and a consumption amount calculation portion. The photosensitive drum is rotated around a predetermined axis and has a circumference surface which allows an electrostatic latent image to be formed thereon and carries a toner image according to the electrostatic latent image. The developing device supplies a toner to the photosensitive drum to make the electrostatic latent image appear as the toner image. The first toner container and the second toner container are capable of storing a toner therein and discharging the toner. The first vertical transport portion guides a toner discharged from the first toner container downward along a vertical direction. The second vertical transport portion guides a toner discharged from the second toner container downward along the vertical direction. The first horizontal transport portion communicates with a lower end portion of the first vertical transport portion and guides a toner flowing in from the first vertical transport portion to a first direction along a horizontal direction. The second horizontal transport portion communicates with a lower end portion of the second vertical transport portion and guides a toner flowing in from the second vertical transport portion to a second direction along the horizontal direction. The first transport member is rotatably arranged in the first horizontal transport portion to transport a toner in the first direction. The second transport member is rotatably arranged in the second horizontal transport portion to transport a toner in the second direction. The transport member drive portion generates a drive force for causing the first transport member and the second transport member to rotate. The container drive portion generates a drive force for discharging a toner from the first toner container and the second toner container. The joining portion communicates with a downstream side part of the first horizontal transport portion in the first direction and a downstream side part of the second horizontal transport portion in the second direction to internally receive toners transported by the first transport member and the second transport member. The first detection sensor is arranged in the first vertical transport portion to detect presence/absence of a toner in the first vertical transport portion. The second detection sensor is arranged in the second vertical transport portion to detect presence/absence of a toner in the second vertical transport portion. The drive controller controls the transport member drive portion and the container drive portion. The drive controller switches a first replenishment state of replenishing a toner from the first toner container to the developing device and a second replenishment state of replenishing a toner from the second toner container to the developing device in response to a toner replenishment request from the developing device and controls the container drive portion according to toner absence information in the first vertical transport portion, the toner absence information being detected by the first detection sensor in the first replenishment state, thus discharging a toner from the first toner container to the first vertical transport portion and causing the first transport member to rotate in response to the replenishment request, and controlling the container drive portion according to toner absence information in the second vertical transport portion, the toner absence information being detected by the second detection sensor in the second replenishment state, thus discharging a toner from the second toner container to the second vertical transport portion and causing the second transport member to rotate in response to the replenishment request. The count portion accumulates rotation time of each of the first transport member and the second transport member. The consumption amount calculation portion calculates a consumption amount of a toner in each of the first toner container and the second toner container by calculating a flow rate of each toner flowing through the first horizontal transport portion and the second horizontal transport portion according to the rotation time accumulated by the count portion.

DETAILED DESCRIPTION

In the following, an image forming device 10 according to one embodiment of the present disclosure will be described in detail with reference to the drawings. In the present embodiment, a tandem color printer will be illustrated as one example of the image forming device. The image forming device may be, for example, a copying machine, a facsimile machine, a multifunctional machine combining the same, or the like. The image forming device may be also a printer, a copying machine, or the like which forms a unicolor (monochrome) image.

Figure 1:
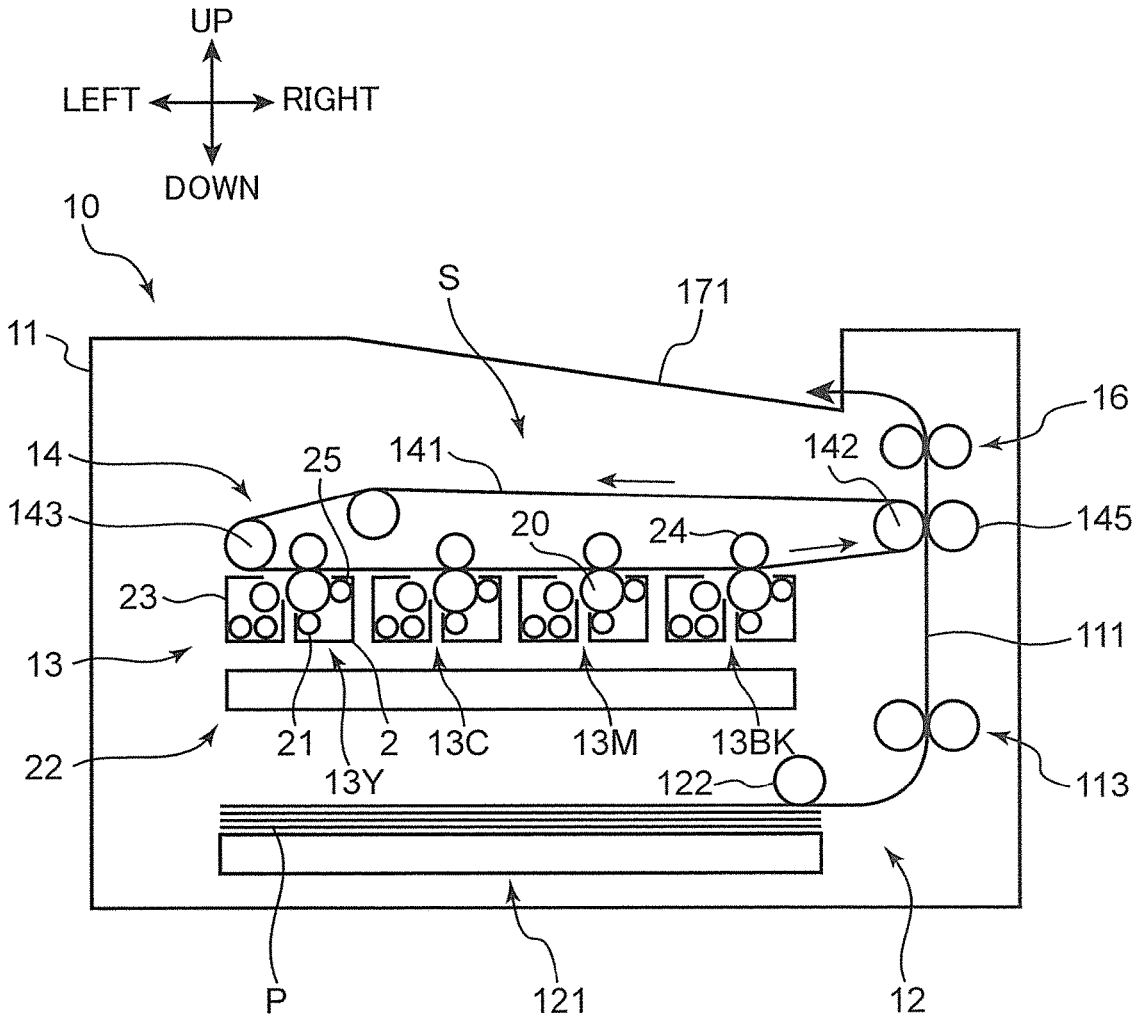
FIG. 1 is a sectional view showing an internal structure of an image forming device according to one embodiment of the present disclosure.

FIG. 1 is a sectional view showing an internal structure of the image forming device 10. The image forming device 10 includes a device main body 11 having a box-shape casing structure. In the device main body 11, there are internally provided a sheet feeding portion 12 which feeds a sheet P, an image forming portion 13 which forms a toner image to be transferred to the sheet P fed by the sheet feeding portion 12, an intermediate transfer unit 14 to which the toner image is primarily transferred, a secondary transfer roller 145, and a fixing portion 16 which executes processing of fixing, to the sheet P, a toner image which is formed on the sheet P and yet to be fixed. Further, in an upper part of the device main body 11, a sheet ejection portion 171 is provided which ejects the sheet P subjected to the fixing processing by the fixing portion 16.

In the device main body 11, a sheet transport path 111 extending in an up-down direction is further formed at the right side of the image forming portion 13. The sheet transport path 111 is provided with a transport roller pair for transporting the sheet P at an appropriate position. Also in the sheet transport path 111, a resist roller pair 113 for conducting skew correction of the sheet P, as well as sending the sheet P to a secondary transfer nip portion to be described later at predetermined timing is provided on the upstream side of the nip portion. The sheet transport path 111 is a transport path for transporting the sheet P from the sheet feeding portion 12 to the sheet ejection portion 171 via the image forming portion 13 (the secondary transfer nip portion) and the fixing portion 16.

The sheet feeding portion 12 includes a sheet feeding tray 121 and a pick-up roller 122. The sheet feeding tray 121 is detachably attached at a lower position of the device main body 11 to store a bundle of sheets including a plurality of stacked sheets P. The pick-up roller 122 feeds an uppermost sheet P of the bundle of the sheets stored in the sheet feeding tray 121 one by one.

The image forming portion 13 forms a toner image to be transferred to the sheet P and includes a plurality of image forming units which form toner images of different colors. As the image forming unit, the present embodiment is provided with a yellow unit 13Y which uses a yellow (Y) color toner, a cyan unit 13C which uses a cyan (C) color toner, a magenta unit 13M which uses a magenta (M) color toner, and a black unit 13BK which uses a black (BK) color toner, the units being sequentially disposed according to a plurality of color toners from an upstream side to a downstream side in a rotation direction of an intermediate transfer belt 141 to be described later (from left to right in FIG. 1). Each unit includes a photosensitive drum 20, a charging device 21, a developing device 23, and a cleaning device 25 arranged on the periphery of the photosensitive drum 20. An exposure device 22 commonly used by the respective units is arranged below the image forming unit.

Figure 2:
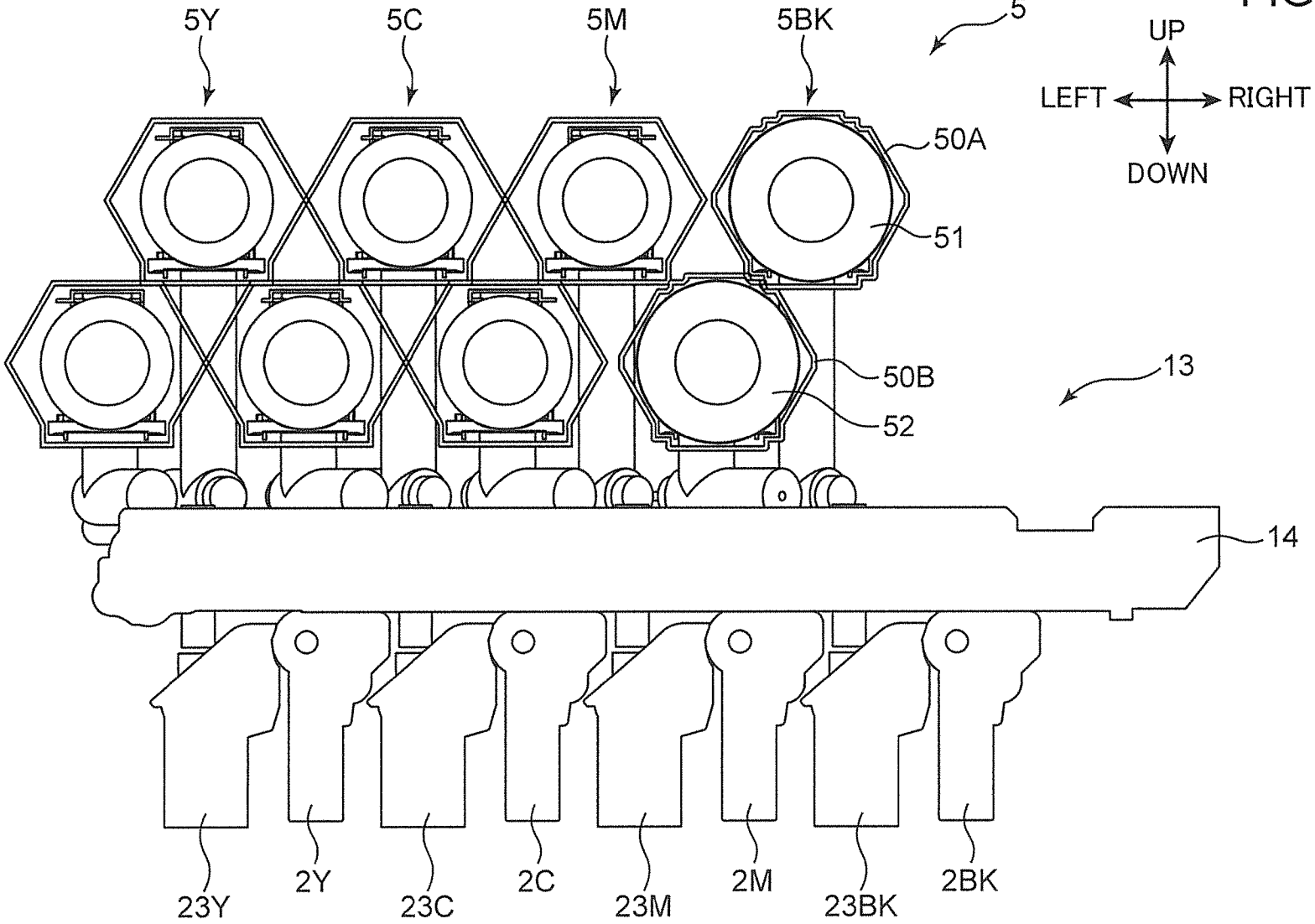
FIG. 2 is a front view of an image forming portion of the image forming device according to one embodiment of the present disclosure.

The photosensitive drum 20 is rotatably driven around a predetermined axis extending in a front-rear direction, and allows an electrostatic latent image to be formed on a circumference surface thereof and also carries a toner image thereon. The charging device 21 uniformly charges a surface of the photosensitive drum 20. The exposure device 22 has various kinds of optical devices such as a light source, a polygon mirror, a reflecting mirror, and a deflecting mirror, and irradiates the uniformly charged circumference surface of the photosensitive drum 20 with light modified based on image data to form an electrostatic latent image. The cleaning device 25 cleans the circumference surface of the photosensitive drum 20 after transfer of a toner image. In the present embodiment, the photosensitive drum 20, the charging device 21, and the cleaning device 25 integrally configure a drum unit 2 (2BK, 2M, 2C, 2Y) (FIG. 1, FIG. 2).

The developing device 23 supplies a toner to the circumference surface of the photosensitive drum 20 for developing (making appear) an electrostatic latent image formed on the photosensitive drum 20. The developing device 23 houses a magnetic one-component toner as a developer. In the present embodiment, the toner has property of being charged to have positive polarity. In other embodiment, the developing device 23 may adopt other developing method such as a method using a two-component developer composed of a toner and a carrier, or a nonmagnetic one-component method.

The intermediate transfer unit 14 is arranged above the image forming portion 13. The intermediate transfer unit 14 includes the intermediate transfer belt 141, a drive roller 142, a follower roller 143, and a primary transfer roller 24.

The intermediate transfer belt 141 is an endless belt-shaped rotary body which extends between the drive roller 142 and the follower roller 143 so as to have a circumference surface side thereof come into contact with the circumference surface of each photosensitive drum 20. The intermediate transfer belt 141 is circularly driven in one direction to carry on a surface thereof a toner image transferred from the photosensitive drum 20.

The drive roller 142 extends the intermediate transfer belt 141 at a right end side of the intermediate transfer unit 14 to circularly drive the intermediate transfer belt 141. The drive roller 142 is formed of a metal roller. The follower roller 143 extends the intermediate transfer belt 141 at a left end side of the intermediate transfer unit 14. The follower roller 143 imparts tension to the intermediate transfer belt 141.

The primary transfer roller 24 forms a primary transfer nip portion with the photosensitive drum 20, with the intermediate transfer belt 141 provided therebetween, so as to primarily transfer a toner image on the photosensitive drum 20 to the intermediate transfer belt 141. The primary transfer roller 24 is arranged to be opposed to the photosensitive drum 20 of each color.

The secondary transfer roller 145 is arranged to be opposed to the drive roller 142 with the intermediate transfer belt 141 provided therebetween. The secondary transfer roller 145 contacts a circumference surface of the intermediate transfer belt 141 by pressure to form the secondary transfer nip portion. A toner image primarily transferred to the intermediate transfer belt 141 is secondarily transferred, in the secondary transfer nip portion, to the sheet P supplied from the sheet feeding portion 12. The intermediate transfer unit 14 and the secondary transfer roller 145 of the present embodiment configure a transfer portion of the present disclosure. The transfer portion transfers a toner image formed in the image forming portion 13 to the sheet P from the photosensitive drum 20.

The sheet P supplied to the fixing portion 16 passes through a fixing nip portion so as to be thermally pressurized. As a result, the toner image transferred to the sheet P by the secondary transfer nip portion is fixed to the sheet P.

The sheet ejection portion 171 is formed by depressing a top portion of the device main body 11. The sheet P subjected to the fixing processing is ejected to the sheet ejection portion 171 via the sheet transport path 111 extending from an upper part of the fixing portion 16.

Figure 3:
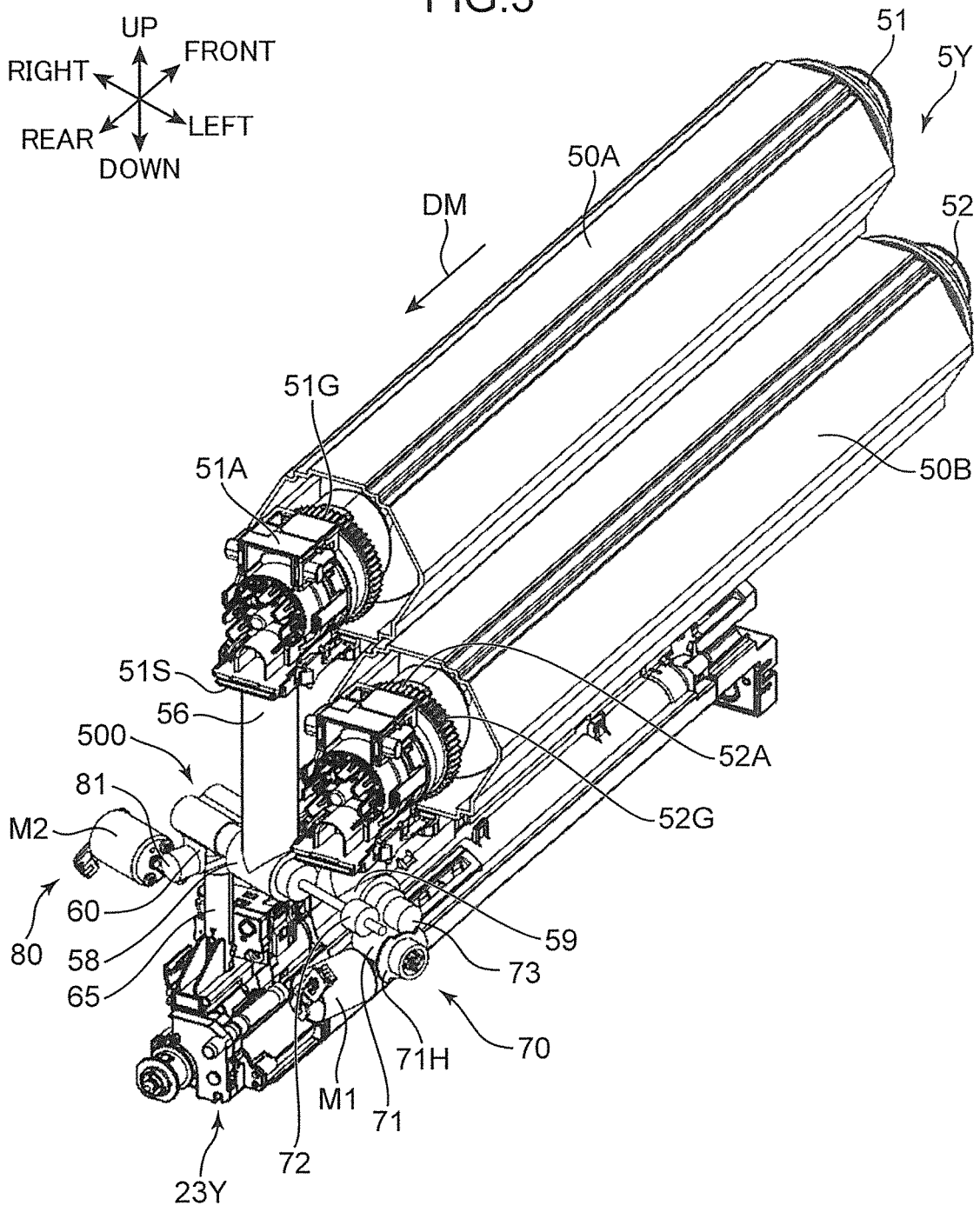
FIG. 3 is a perspective view of a toner replenishing unit and a developing device of the image forming device according to one embodiment of the present disclosure.
Figure 4:
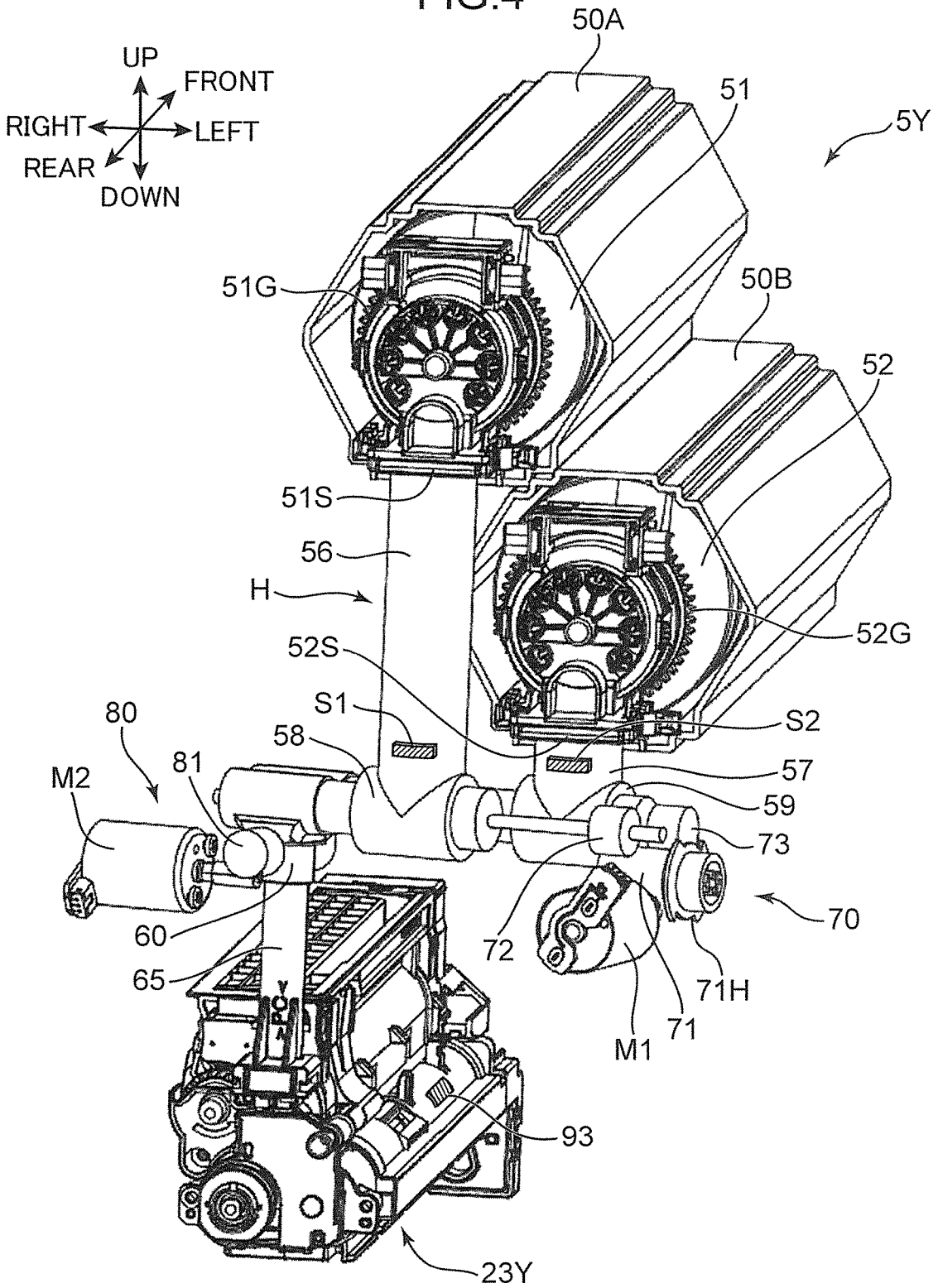
FIG. 4 is a perspective view of the toner replenishing unit and the developing device of the image forming device according to one embodiment of the present disclosure.
Figure 5:
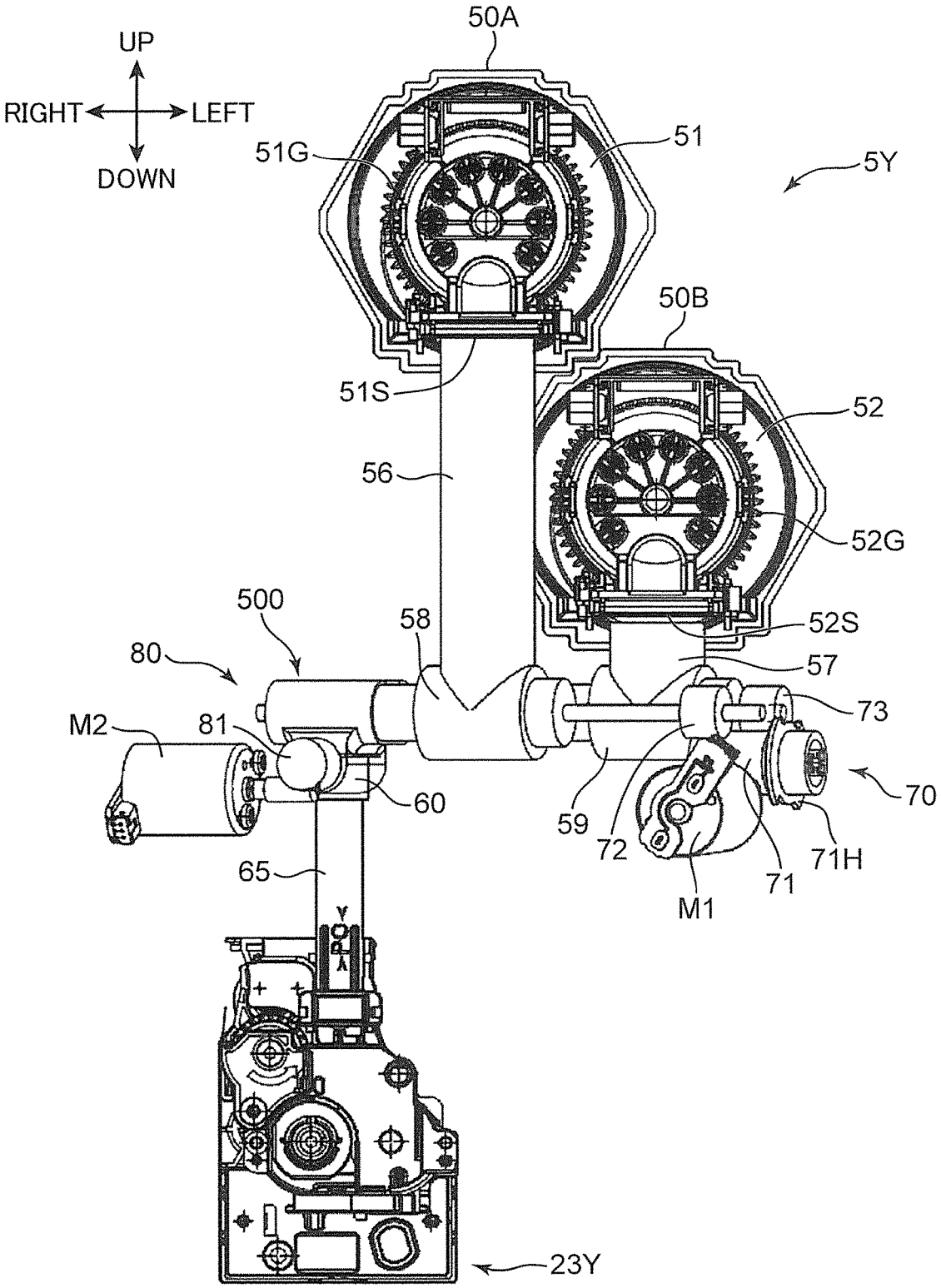
FIG. 5 is a rear view of the toner replenishing unit and the developing device of the image forming device according to one embodiment of the present disclosure.

FIG. 2 is a front view of the image forming portion 13 of the image forming device 10 according to the present embodiment. FIG. 3 and FIG. 4 are perspective views of a toner replenishing unit 5Y and a developing device 23Y for yellow color in the image forming device 10 according to the present embodiment, and FIG. 5 is a rear view of the same.

With reference to FIG. 2 to FIG. 5, the image forming device 10 further includes toner replenishing units 5 corresponding to the respective colors. The toner replenishing unit 5 replenishes the developing device 23 for each color with a toner. As shown in FIG. 2, the toner replenishing units 5 of the respective colors (5BK, 5M, 5C, 5Y) are horizontally arranged adjacent to each other in the present embodiment. Since structures of the toner replenishing units 5 and the developing devices 23 (23BK, 23M, 23C, 23Y) of the respective colors are the same, description will be made of the toner replenishing unit 5Y and the developing device 23Y for yellow color as required in the following.

The toner replenishing unit 5 of each color has an upper toner container 51 (a first toner container), a lower toner container 52 (a second toner container), an upper housing 50A, and a lower housing 50B.

The upper toner container 51 and the lower toner container 52 each extend along an axial direction of the photosensitive drum 20, and are capable of storing a toner therein and discharging the toner. The upper toner container 51 and the lower toner container 52 are attached to the device main body 11 of the image forming device 10 along an attachment direction DM (to the rear in FIG. 3) along the axial direction of the photosensitive drum 20. In the present embodiment, the upper toner container 51 and the lower toner container 52 each have a cylindrical shape and have an outer circumference surface on which a spiral groove extending spirally along an axial direction is formed. The spiral groove forms a spiral protrusion portion which protrudes into an inner space of each of the upper toner container 51 and the lower toner container 52. Then, rotation of the upper toner container 51 and the lower toner container 52 causes an inside toner to be transported toward the rear side by the spiral protrusion portion. The upper toner container 51 has a fixed portion 51A and a first container gear 51G (FIG. 3). The fixed portion 51A does not rotate, and a part of the upper toner container 51 more ahead of the fixed portion 51A is configured to be rotatable relative to the fixed portion 51A. The first container gear 51G is a gear fixed to the outer circumference part of the upper toner container 51 at a position forward of the fixed portion 51A. Transmission of a rotation force to the first container gear 51G causes the forward part of the upper toner container 51 to rotate.

The lower toner container 52 similarly has a fixed portion 52A and a second container gear 52G (FIG. 3). The fixed portion 52A does not rotate, and a part of the lower toner container 52 more ahead of the fixed portion 52A is configured to be rotatable relative to the fixed portion 52A. The second container gear 52G is a gear fixed to the outer circumference part of the lower toner container 52 at a position forward of the fixed portion 52A. Transmission of a rotation force to the second container gear 52G causes the forward part of the lower toner container 52 to rotate.

The upper toner container 51 has a first toner discharge port (not shown) formed at a front end side (the fixed portion 51A) in the direction DM of attachment to the upper housing 50A, and the lower toner container 52 has a second toner discharge port (not shown) formed at a front end side (the fixed portion 52A) in the direction DM of attachment to the lower housing 50B. A toner is discharged from these toner discharge ports. The upper toner container 51 and the lower toner container 52 include shutters 51S and 52S (FIG. 4) which block the toner discharge ports, respectively. When the upper toner container 51 and the lower toner container 52 are attached to the upper housing 50A and the lower housing 50B, these shutters are slid to move and open the respective toner discharge ports. Also in the present embodiment, the upper toner container 51 and the lower toner container 52 are toner containers having the same shape. In other words, the toner container of each color applied to the image forming device 10 is attachable to either of the upper housing 50A and the lower housing 50B in the toner replenishing unit 5 of the corresponding color. The upper toner container 51 and the lower toner container 52 of each color are arranged in a container space S of the device main body 11 shown in FIG. 1.

The upper housings 50A are arranged above the developing device 23 so as to be spaced from each other in the device main body 11 and each allow the upper toner container 51 to be attached inside the upper housing 50A along the attachment direction DM, as well as receiving the upper toner container 51. The lower housings 50B are arranged above the developing device 23 and below the upper housing 50A in the device main body 11 and each allow the lower toner container 52 to be attached inside the lower housing 50B along the attachment direction DM, as well as receiving the lower toner container 52.

With reference to FIG. 3, in the present embodiment, the lower housing 50B positions the lower toner container 52 in the device main body such that a front end portion (a rear end portion) of the lower toner container 52 in the attachment direction is arranged at the same position in the attachment direction as a front end portion (a rear end portion) of the upper toner container 51 attached to the upper housing 50A in the attachment direction. Further, the lower housing 50B is horizontally arranged at a position above the developing device 23 and below the upper housing 50A, the position being displaced leftward from the upper housing 50A in a direction (a right and left direction) orthogonal to the axial direction of the photosensitive drum 20 in the device main body 11 (FIG. 2 to FIG. 4). As a result, a container stepped portion H is formed in a space below the front end portion of the upper toner container 51 in the attachment direction (the rear end portion of the upper toner container 51), the space being opposed, in the horizontal direction orthogonal to the axial direction of the photosensitive drum 20, to the front end portion of the lower toner container 52 in the attachment direction (FIG. 4).

Figure 6:
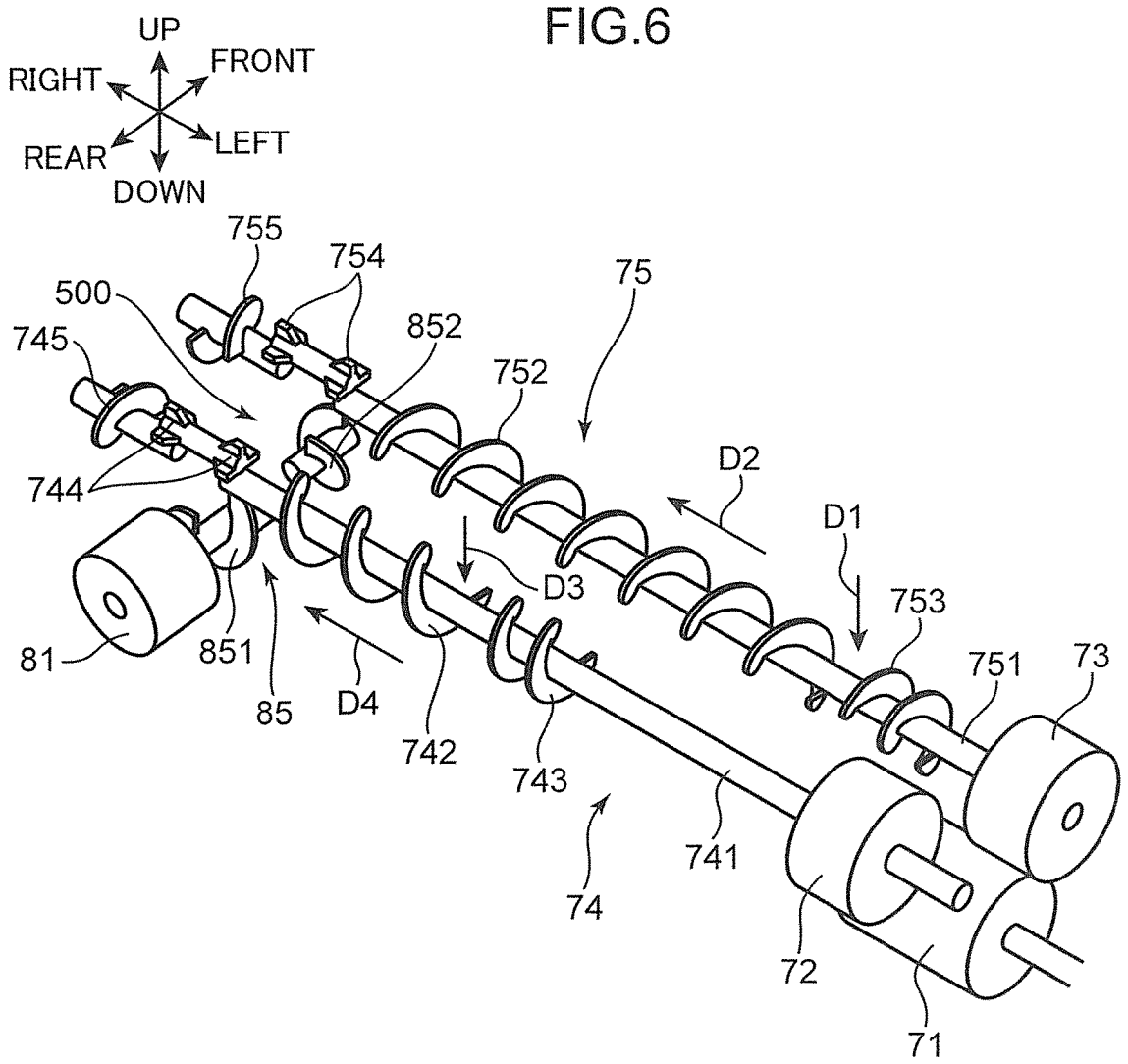
FIG. 6 is a perspective view of a first transport member, a second transport member, and a joining portion according to one embodiment of the present disclosure.
Figure 7:
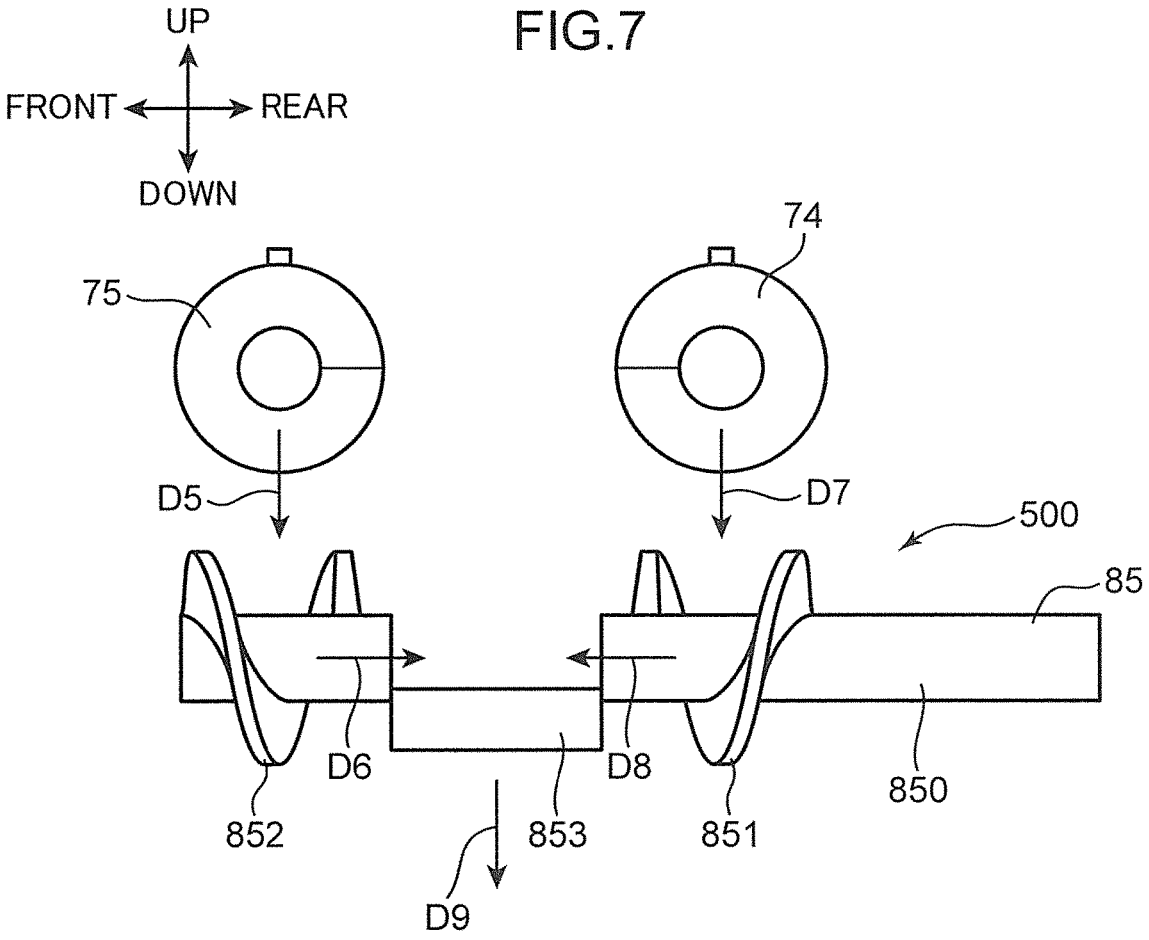
FIG. 7 is a side view of the first transport member, the second transport member, and the joining portion according to one embodiment of the present disclosure.
Figure 8:
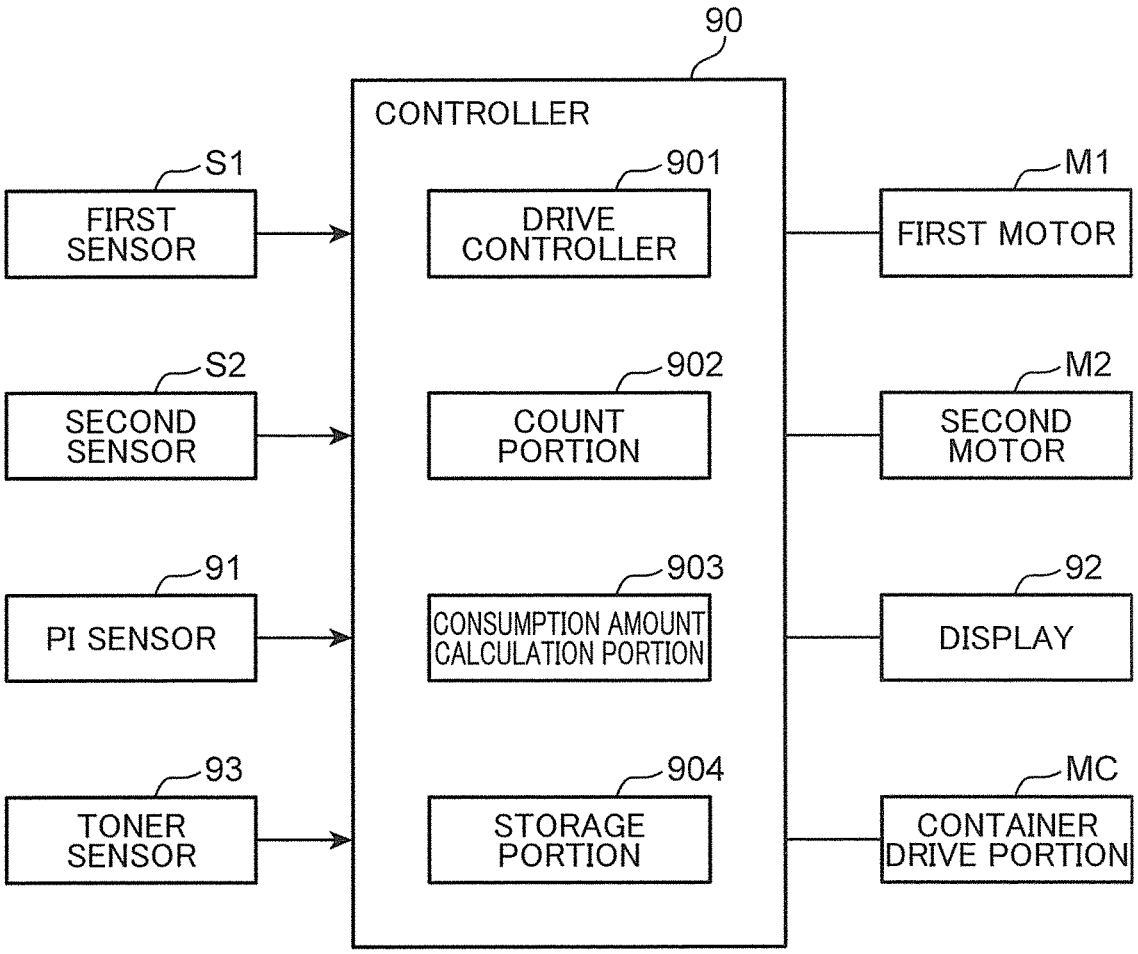
FIG. 8 is a block diagram of a controller of the image forming device according to one embodiment of the present disclosure.

FIG. 6 is a perspective view of a first transport screw 74, a second transport screw 75, and a joining portion 500 according to the present embodiment, and FIG. 7 is a side view of the same. The toner replenishing unit 5 further has a first vertical transport portion 56, a second vertical transport portion 57, a first horizontal transport portion 58, a second horizontal transport portion 59, a first transport screw 74 (a first transport member), a second transport screw 75 (a second transport member), a first screw drive portion 70 (a transport member drive portion)(FIG. 4), a second screw drive portion 80, a container drive portion MC (FIG. 8), the joining portion 500, a first sensor S1 (a first detection sensor), a second sensor S2 (a second detection sensor), and a controller 90 (FIG. 8).

The first vertical transport portion 56 is arranged at the container stepped portion H. The first vertical transport portion 56 is a pipe-shaped member extending downward from the first container shutter 51S. The first vertical transport portion 56 guides a toner discharged from the upper toner container 51 downward along the vertical direction. Therefore, when the upper toner container 51 is attached to the upper housing 50A, the fixed portion 51A of the upper toner container 51 and the first vertical transport portion 56 communicate with each other.

The second vertical transport portion 57 is a pipe-shaped member extending downward from the second container shutter 52S. The second vertical transport portion 57 guides a toner discharged from the lower toner container 52 downward along the vertical direction. Therefore, when the lower toner container 52 is attached to the lower housing 50B, the fixed portion 52A of the lower toner container 52 and the second vertical transport portion 57 communicate with each other.

The first horizontal transport portion 58 is a horizontally extending pipe-shaped member. The first horizontal transport portion 58 receives a toner from the first vertical transport portion 56 and transmits a toner to the joining portion 500 while transporting the toner forward and rightward (in the first direction) along the horizontal direction. In other words, the first horizontal transport portion 58 communicates with a lower end portion of the first vertical transport portion 56 and guides a toner flowing in from the first vertical transport portion 56 to the first direction along the horizontal direction.

The second horizontal transport portion 59 is a horizontally extending pipe-shaped member. The second horizontal transport portion 59 receives a toner from the second vertical transport portion 57 and transmits a toner to the joining portion 500 while transporting the toner forward and rightward along the horizontal direction. In other words, the second horizontal transport portion 59 communicates with a lower end portion of the second vertical transport portion 57 and guides a toner flowing in from the second vertical transport portion 57 along the first direction.

The first transport screw 74 (FIG. 6) is rotatably arranged in the first horizontal transport portion 58 and transports a toner in the first direction. The first transport screw 74 has a first shaft 741, a first main transport vane 742, a first upstream side sub-transport vane 743, a first paddle 744, and a first downstream side sub-transport vane 745.

The first shaft 741 serves as a rotation axis in the rotation of the first transport screw 74. The first main transport vane 742 is a spiral vane arranged, on the first shaft 741, from a position at which a toner flows from the first vertical transport portion 56 into the first horizontal transport portion 58 (see an arrow D3 in FIG. 6) toward the right side. The first main transport vane 742 transports a toner rightward (see an arrow D4 in FIG. 6). The first upstream side sub-transport vane 743 is a spiral vane arranged, on the first shaft 741, leftward of the first main transport vane 742 (an upstream side in a toner transport direction). The first upstream side sub-transport vane 743 transports a toner in the same direction as that of the first main transport vane 742 and prevents transport of a toner to the first one-way gear 72 side. The first paddle 744 is a paddle arranged, on the first shaft 741, rightward of the first main transport vane 742 (a downstream side in the toner transport direction). The first paddle 744 causes a toner to be sent into the horizontal joining portion 60 of the joining portion 500 from the first horizontal transport portion 58 (see an arrow D7 in FIG. 7). The first downstream side sub-transport vane 745 is a spiral vane arranged, on the first shaft 741, rightward of the first paddle 744. The first downstream side sub-transport vane 745 prevents entry of a toner into a right end portion side of the first horizontal transport portion 58 (the first transport screw 74) by transporting a toner in a direction (leftward) opposite to the first main transport vane 742.

The second transport screw 75 (FIG. 7) is rotatably arranged in the second horizontal transport portion 59 to transport a toner in the first direction. The second transport screw 75 has a second shaft 751, a second main transport vane 752, a second upstream side sub-transport vane 753, a second paddle 754, and a second downstream side sub-transport vane 755.

The second shaft 751 serves as a rotation axis in the rotation of the second transport screw 75. The second main transport vane 752 is a spiral vane arranged, on the second shaft 751, from a position at which a toner flows from the second vertical transport portion 57 into the second horizontal transport portion 59 (see an arrow D1 in FIG. 6) toward the right side. The second main transport vane 752 transports a toner rightward (see an arrow D2 in FIG. 6). The second upstream side sub-transport vane 753 is a spiral vane arranged, on the second shaft 751, leftward of the second main transport vane 752 (the upstream side in the toner transport direction). The second upstream side sub-transport vane 753 transports a toner in the same direction as that of the second main transport vane 752 and prevents transport of a toner to a second one-way gear 73 side. The second paddle 754 is a paddle arranged, on the second shaft 751, rightward of the second main transport vane 752 (the downstream side in the toner transport direction). The second paddle 754 causes a toner to be sent into the horizontal joining portion 60 of the joining portion 500 from the second horizontal transport portion 59 (see an arrow D5 in FIG. 7). The second downstream side sub-transport vane 755 is a spiral vane arranged, on the second shaft 751, rightward of the second paddle 754. The second downstream side sub-transport vane 755 prevents entry of a toner into a right end portion side of the second horizontal transport portion 59 (the second transport screw 75) by transporting a toner in a direction (leftward) opposite to the second main transport vane 752.

The first screw drive portion 70 (FIG. 3) generates a drive force which causes the first transport screw 74 and the second transport screw 75 to rotate. The first screw drive portion 70 has a first motor M1, a first worm wheel 71, the first one-way gear 72, the second one-way gear 73, and a PI sensor 91 (FIG. 8).

The first motor M1 is a motor rotatable in a first rotation direction and a second rotation direction reverse to the first rotation direction. Rotation, stop, and a rotation direction of the first motor M1 are controlled by a drive controller 901 of the controller 90 to be described later.

The first worm wheel 71 is coupled to an output shaft of the first motor M1. The first worm wheel 71 is also configured to be rotatable in a different rotation direction according to a rotation direction of the first motor M1. The first worm wheel 71 includes a detected piece 71H. The detected piece 71H is fixed to one end of the first worm wheel 71 in an axial direction thereof, and has a pair of slits formed in a circumferential direction thereof as shown in FIG. 3 and FIG. 4. Detection of rotation of the detected piece 71H by the PI sensor 91 (FIG. 8) leads to detection of rotation rates (accumulated rotation rates) of the first transport screw 74 and the second transport screw 75.

The first one-way gear 72 is a gear engaged with the first worm wheel 71 and is fixed to one end of the first shaft 741 of the first transport screw 74. When a rotation drive force is transmitted from the first worm wheel 71 to the first one-way gear 72, the first transport screw 74 rotates to transport a toner. Specifically, the first one-way gear 72, which is interposed between the first motor M1 and the first transport screw 74, allows the first transport screw 74 to rotate when the first motor M1 is rotated in the first rotation direction, and regulates rotation of the first transport screw 74 when the first motor M1 is rotated in the second rotation direction.

Similarly, the second one-way gear 73 is a gear engaged with the first worm wheel 71 at a position different from that of the first one-way gear 72 and is fixed to one end of the second shaft 751 of the second transport screw 75. When a rotation drive force is transmitted from the first worm wheel 71 to the second one-way gear 73, the second transport screw 75 rotates to transport a toner. Specifically, the second one-way gear 73, which is interposed between the first motor M1 and the second transport screw 75, allows the second transport screw 75 to rotate when the first motor M1 is rotated in the second rotation direction, and regulates rotation of the second transport screw 75 when the first motor M1 is rotated in the first rotation direction.

The PI sensor 91 (FIG. 8) is arranged to be opposed to the detected piece 71H of the first worm wheel 71 in the device main body 11 of the image forming device 10. The PI sensor 91 includes a light emission portion (not shown) which emits detection light and a light reception portion which receives the detection light. The detected piece 71H shields detection light, while detection light is transmitted through the slit part of the detected piece 71H, so that rotation of the first worm wheel 71 is detected.

The joining portion 500 communicates with a downstream side part of the first horizontal transport portion 58 in the first direction and with a downstream side part of the second horizontal transport portion 59 in the first direction. The joining portion 500 internally receives toners transported by the first transport screw 74 and the second transport screw 75 and transports the toners toward the developing device 23 (23Y in FIG. 3). The joining portion 500 has the horizontal joining portion 60 and a third vertical transport portion 65.

The horizontal joining portion 60 has a pipe-shape and is arranged to extend in the front-rear direction below the right end portions of the first horizontal transport portion 58 and the second horizontal transport portion 59. The horizontal joining portion 60 has a third transport screw 85 rotatably arranged in the pipe-shape. The third transport screw 85 has a function of transporting a toner in the horizontal joining portion 60. The third transport screw 85 has a third shaft 850, a third main transport vane 851 (a third horizontal transport member), a fourth main transport vane 852 (a fourth horizontal transport member), and a third paddle 853.

The third shaft 850 (FIG. 7) serves as a rotation axis in the rotation of the third transport screw 85. The third main transport vane 851 is a spiral vane arranged on the third shaft 850 below the first transport screw 74. While transporting a toner received from the first horizontal transport portion 58 (the first transport screw 74) toward the front (a third direction, see an arrow D8 in FIG. 7) along the horizontal direction, the third main transport vane 851 causes the toner to flow into the third vertical transport portion 65. Similarly, the fourth main transport vane 852 is a spiral vane arranged on the third shaft 850 below the second transport screw 75. While transporting a toner received from the second horizontal transport portion 59 (the second transport screw 75) toward the rear side along the horizontal direction (a fourth direction opposite to the third direction, see an arrow D6 in FIG. 7) along the horizontal direction, the fourth main transport vane 852 causes the toner to flow into the third vertical transport portion 65. The third paddle 853 is formed by partly bending the third shaft 850 between the third main transport vane 851 and the fourth main transport vane 852. Specifically, the third paddle 853 extends, at a position displaced from an axis of the third shaft 850 in a radial direction, along an axial direction of the third shaft 850. The third paddle 853 assists the toner transported by the third main transport vane 851 and the fourth main transport vane 852 to flow into the third vertical transport portion 65 as the third transport screw 85 rotates (seen an arrow D9 in FIG. 7).

The third vertical transport portion 65 has a pipe-shape and is arranged to extend downward from a central part, in the front-rear direction, of the horizontal joining portion 60 along the vertical direction. An upper end portion of the third vertical transport portion 65 communicates with the horizontal joining portion 60, and a lower end portion of the third vertical transport portion 65 communicates with the developing device 23Y. When viewed along the right and left direction (the first direction), the third vertical transport portion 65 is arranged below the first horizontal transport portion 58 and the second horizontal transport portion 59 and between the first horizontal transport portion 58 and the second horizontal transport portion 59 to transport a toner downward along the vertical direction until the toner reaches the developing device 23Y.

The second screw drive portion 80 causes the third transport screw 85 of the joining portion 500 to rotate. The second screw drive portion 80 has a second motor M2 and a second worm wheel 81.

The second motor M2 is a motor configured to be rotatable in a predetermined rotation direction. Rotation, stop, and a rotation direction of the second motor M2 are controlled by the drive controller 901 of the controller 90 to be described later.

The second worm wheel 81 is coupled to an output shaft of the second motor M2. The second worm wheel 81 is also configured to be rotatable as the second motor M2 rotates. The second worm wheel 81 is also fixed to one end of the third shaft 850 of the third transport screw 85. When a rotation drive force is transmitted from the second motor M2 to the second worm wheel 81, the third transport screw 85 rotates to transport a toner.

The container drive portion MC generates a drive force for discharging a toner from the upper toner container 51 and the lower toner container 52. In the present embodiment, the container drive portion MC includes a motor (not shown) which is coupled to the above-described first container gear 51G and second container gear 52G. The motor may be arranged one for each of the first container gear 51G and the second container gear 52G, or the first container gear 51G or the second container gear 52G may be selectively rotated according to a rotation direction of one motor as in the first screw drive portion 70 described above.

While in the present embodiment, such a transport screw as described above is not arranged in the first vertical transport portion 56, the second vertical transport portion 57, and the third vertical transport portion 65, a stirring member which rotates or moves up and down for preventing aggregation of a toner in the transport portion may be arranged in other embodiment.

The first sensor S1 is arranged to be opposed to the first vertical transport portion 56 to detect presence/absence of a toner in a pipe of the first vertical transport portion 56. Similarly, the second sensor S2 is arranged to be opposed to the second vertical transport portion 57 to detect presence/absence of a toner in a pipe of the second vertical transport portion 57. These sensors are formed with permeability sensors. In a case where the first vertical transport portion 56 or the second vertical transport portion 57 is internally filled with a sufficient toner, each sensor outputs a HIGH signal (+5 V). On the other hand, in a case where a toner hardly exists in the first vertical transport portion 56 or the second vertical transport portion 57, each sensor outputs a LOW signal (0 V). In other embodiment, these sensors may be PI sensors (photo sensors). In this case, the first vertical transport portion 56 and the second vertical transport portion 57 are made of transparent pipe members, and the PI sensors detect presence/absence of a toner in the first vertical transport portion 56 and the second vertical transport portion 57.

FIG. 8 is a block diagram of the controller 90 of the image forming device 10 according to the present embodiment. The controller 90 is configured with a CPU (Central Processing Unit), a ROM (Read Only Memory) which stores a control program, a RAM (Random Access Memory) used as a working region of a CPU, and the like. In addition to the above-described first sensor S1, second sensor S2, PI sensor 91, container drive portion MC, first motor M1, and second motor M2, a display 92, a toner sensor 93, and the like are electrically connected to the controller 90. The controller 90 is also connected to a network for transmitting operation information or failure information of the image forming device 10 to an information management center at a remote site.

The toner sensor 93 (FIG. 4, FIG. 8) is provided in the developing device 23 (23Y) to output a detection signal according to an amount of a toner in the developing device 23. In a case where the amount of the toner in the developing device 23 is not less than a predetermined threshold value, the toner sensor 93 outputs the HIGH signal (+5 V). On the other hand, in a case where the amount of the toner in the developing device 23 is less than the predetermined threshold value, the toner sensor 93 outputs the LOW signal (0 V). The toner sensor 93 may output a larger detection signal (voltage) as the amount of the toner in the developing device 23 becomes larger. The detection signal output by the toner sensor 93 is referred to by the drive controller 901 of the controller 90 as a toner replenishment request from the developing device 23.

The display 92 is provided in an operation portion (not shown) of the image forming device 10. The display 92 displays operation information, an operation state, and the like of the image forming device 10.

Execution of the control program stored in the ROM by the CPU allows the controller 90 to function in such a manner that the drive controller 901, a count portion 902, a consumption amount calculation portion 903, and a storage portion 904 are provided.

The drive controller 901 controls drive of the first motor M1, the second motor M2, and the container drive portion MC. The drive controller 901 switches a first replenishment state of replenishing a toner from the upper toner container 51 to the developing device 23 in response to a toner replenishment request from the developing device 23 (23Y) and a second replenishment state of replenishing a toner from the lower toner container 52 to the developing device 23.

In the first replenishment state, the drive controller 901 controls the container drive portion MC according to the LOW signal (the toner absence information in the first vertical transport portion 56) detected by the first sensor S1 to cause discharge of a toner from the upper toner container 51 to the first vertical transport portion 56, and controls to drive the first motor M1 in the first rotation direction, thus causing the first transport screw 74 to rotate in response to the replenishment request.

On the other hand, in the second replenishment state, the drive controller 901 controls the container drive portion MC according to the LOW signal (the toner absence information in the second vertical transport portion 57) detected by the second sensor S2 to cause discharge of a toner from the lower toner container 52 to the second vertical transport portion 57, and controls to drive the first motor M1 in the second rotation direction, thus causing the second transport screw 75 to rotate in response to the replenishment request.

The drive controller 901 controls drive of the second motor M2 in synchronization with rotation drive of the first transport screw 74 or the second transport screw 75 to cause the third transport screw 85 to rotate.

The count portion 902 accumulates each rotation time of the first transport screw 74 and the second transport screw 75. At this time, the count portion 902 detects the rotation times of the first transport screw 74 and the second transport screw 75 by referring to an output signal of the PI sensor 91 according to rotation of the detected piece 71H of the first worm wheel 71.

By calculating a flow rate of each toner flowing through the first horizontal transport portion 58 and the second horizontal transport portion 59 according to the rotation times accumulated by the count portion 902, the consumption amount calculation portion 903 calculates a consumption amount of a toner in each of the upper toner container 51 and the lower toner container 52. A flow rate of the toner in each of the first horizontal transport portion 58 and the second horizontal transport portion 59 is calculated by a product of a pipe-shaped cross section of each transport portion, a rotation rate (rotation speed) of each transport screw, and a pitch of a spiral vane of each of the first main transport vane 742 and the second main transport vane 752. At this time, since a toner is replenished from the upper toner container 51 and the lower toner container 52 to the first vertical transport portion 56 and the second vertical transport portion 57 according to detection signals of the first sensor S1 and the second sensor S2 as necessary, the first horizontal transport portion 58 and the second horizontal transport portion 59 are maintained at a state of being filled with a toner. Accordingly, the above product enables a flow rate of a toner to be calculated with excellent accuracy. Then, a toner consumption amount of the upper toner container 51 or the lower toner container 52 can be calculated by multiplying the calculated flow rate of a toner in the first horizontal transport portion 58 or the second horizontal transport portion 59 by the accumulated rotation time counted by the count portion 902.

When new upper toner container 51 and lower toner container 52 are attached to the image forming device 10, the count portion 902 resets accumulated rotation time. For obtaining information about attachment of the new upper toner container 51 and lower toner container 52, information of a RFID memory (not shown) which is provided in each container may be referred to, or the information may be input by a user or a maintenance worker from the operation portion (not shown) of the image forming device 10. When a consumption amount of each toner container comes close to a toner charge amount of the new toner container, the consumption amount calculation portion 903 causes the display 92 to display empty information of the toner container. As a result, the user is allowed to recognize that the toner container is getting close to being empty or has become empty. As described above, in a case where one of the upper toner container 51 and the lower toner container 52 has become empty (empty), the drive controller 901 switches drive of the container drive portion MC, the first motor M1, and the second motor M2 to replenish a toner from the other toner container to the developing device 23.

The storage portion 904 stores in advance various threshold value information to be referred to by the drive controller 901 and the consumption amount calculation portion 903, arithmetic information for use in arithmetic, such as a constant, and the like.

As described above, in the present embodiment, two toner containers are arranged for the developing device 23 in the device main body 11. Then, the upper toner container 51 and the lower toner container 52 are arranged in the device main body 11 so as to be adjacent to each other horizontally and in the up-down direction (obliquely). Therefore, as compared with a case where two toner containers are arranged to be adjacent to each other only horizontally, an increase in a horizontal width of the device main body 11 can be prevented. The drive controller 901 of the controller 90 controls the drive system (the container drive portion MC, the first motor M1, and the second motor M2) of the toner replenishing unit 5 so as to supply a toner from one toner container of the upper toner container 51 or the lower toner container 52 to the developing device 23, and when the one toner container becomes empty, so as to supply a toner from the other toner container of the upper toner container 51 or the lower toner container 52 to the developing device 23. Therefore, even when the upper toner container 51 becomes empty, the lower toner container 52 enables image forming operation to be executed quickly. As a result, it is possible to reduce frequency and time of stop of the image forming operation caused by replacement of the toner container.

Also in the present embodiment, toner consumption amounts of the upper toner container 51 and the lower toner container 52 are calculated based on the flow rates of toners in the first horizontal transport portion 58 and the second horizontal transport portion 59 which are located upstream of the joining portion 500. Therefore, it is possible to calculate consumption amounts of two toner containers independently with excellent accuracy. Additionally, the container drive portion MC is controlled according to detection information of the first sensor S1 and the second sensor S2 such that the first vertical transport portion 56 and the second vertical transport portion 57, which are located upstream of the first horizontal transport portion 58 and the second horizontal transport portion 59, are filled with a toner. Therefore, it is possible to suppress toner filling rates of the first horizontal transport portion 58 and the second horizontal transport portion 59 from becoming unstable, so that the toner consumption amounts of the upper toner container 51 and the lower toner container 52 can be calculated with excellent accuracy based on the flow rates of toners in the first horizontal transport portion 58 and the second horizontal transport portion 59.

Also in the present embodiment, the upper toner container 51 and the lower toner container 52 are arranged at the same position in the attachment direction in the device main body 11. Therefore, as compared with a case where the upper toner container 51 and the lower toner container 52 are displaced from each other in the front-rear direction, the size of the device main body 11 in the front-rear direction can be reduced. Then, using the container stepped portion H formed by the two toner containers, a part of the toner replenishing unit 5 can be efficiently arranged.

Also in the present embodiment, the first vertical transport portion 56 is provided for transporting a toner downward which is discharged from the upper toner container 51 located above the lower toner container 52. Then, the first vertical transport portion 56 can be arranged using the container stepped portion H. Therefore, as compared with a case where the lower toner container 52 is arranged immediately below the upper toner container 51, the first vertical transport portion 56 extending along the vertical direction can be efficiently arranged.

Further, in the present embodiment, the toner replenishing unit 5 includes the first horizontal transport portion 58 and the second horizontal transport portion 59. It is therefore possible to fill the horizontal joining portion 60 with a toner more stably as compared with a case where a toner directly flows into the horizontal joining portion 60 from the first vertical transport portion 56 and the second vertical transport portion 57. As a result, a toner can be stably replenished to the developing device 23 via the third vertical transport portion 65.

Also in the present embodiment, transmission of a rotation drive force to the first transport screw 74 and the second transport screw 75 can be switched according to a rotation direction of the first motor M1. It is therefore possible to selectively cause the first transport screw 74 and the second transport screw 75 to rotate using the rotation drive force of the single first motor M1. This enables selective transport of a toner in the first horizontal transport portion 58 and the second horizontal transport portion 59, so that a more compact toner replenishing system of the image forming device 10 can be realized at low costs.

In the present embodiment, the image forming portion 13 includes a plurality of image forming units 13BK, 13M, 13C, 13Y arranged corresponding to a plurality of color toners, and the upper toner containers 51 of the plurality of image forming units are arranged adjacent to each other in the horizontal direction and the lower toner containers 52 of the plurality of image forming units are arranged adjacent to each other in the horizontal direction. Further, when viewed along the axial direction of the photosensitive drum 20, the upper toner containers 51 and the lower toner containers 52 of the plurality of image forming units are arranged in a staggered manner. Therefore, even in a configuration where an image is formed on the sheet P by a plurality of color toners, frequency of stoppage of image forming operation due to replacement of each color toner container can be reduced, while preventing an increase in a horizontal width of the device main body 11. Additionally, as shown in FIG. 2, the intermediate transfer unit 14 is arranged by making use of a height for replenishing a toner to the developing device 23 from the upper toner container 51 and the lower toner container 52 of each color. In other words, the toner replenishing unit 5 of each color is arranged by making use of a position above and backward of the intermediate transfer unit 14.

In the present embodiment, the third transport screw 85 is arranged within the horizontal joining portion 60. The third transport screw 85 has the third main transport vane 851 and the fourth main transport vane 852. Then, with the directions of the toners transported by the third main transport vane 851 and the fourth main transport vane 852 being reverse to each other, the toners are sent into the third vertical transport portion 65 through a middle portion of the vanes. This makes replenishment toners difficult to be mixed with each other until the toners reach the third vertical transport portion 65, thereby enabling stable toner replenishment from each toner container to the developing device 23. Additionally, toner consumption amounts of the upper toner container 51 and the lower toner container 52 can be calculated with excellent accuracy. Additionally, since the third transport screw 85 includes the third paddle 853, aggregation of toners transported by the third main transport vane 851 and the fourth main transport vane 852 near an inlet of the third vertical transport portion 65 can be prevented.

The image forming devices 10 according to one embodiment of the present disclosure have been described above in detail. Such a configuration provides an image forming device which includes a toner supply system in which toners discharged from the plurality of toner containers are joined and supplied to the developing device and which is capable of calculating a toner consumption amount of each toner container with excellent accuracy. Note that the present disclosure is not limited thereto. The present disclosure can assume such a modified embodiment as set forth below.

(1) While in the above-described embodiments, the description has been made of a mode in which the toner replenishing units 5 and the developing devices 23 are arranged according to toners of four colors, the present disclosure may be applicable to such an image forming device for single color (monochrome device etc.) having the structure as shown in FIG. 3.

(2) While the above-described embodiment has been described with respect to a mode in which the upper toner container 51 and the lower toner container 52 transport toners contained therein as a result of rotation of the main body portions of the containers, the toner container may include therein a rotatable toner transportation member such as a screw.

(3) A toner replenishment request from the developing device 23, which request is to be referred to by the drive controller 901 for toner discharge from the upper toner container 51 and the lower toner container 52, is not limited to an output of the toner sensor 93. A mode may be applicable in which toner replenishment to the developing device 23 is determined based on other information such as image information in the image forming device 10, or concentration information of a patch image on the intermediate transfer belt 141 of the intermediate transfer unit 14.

Figure 9:
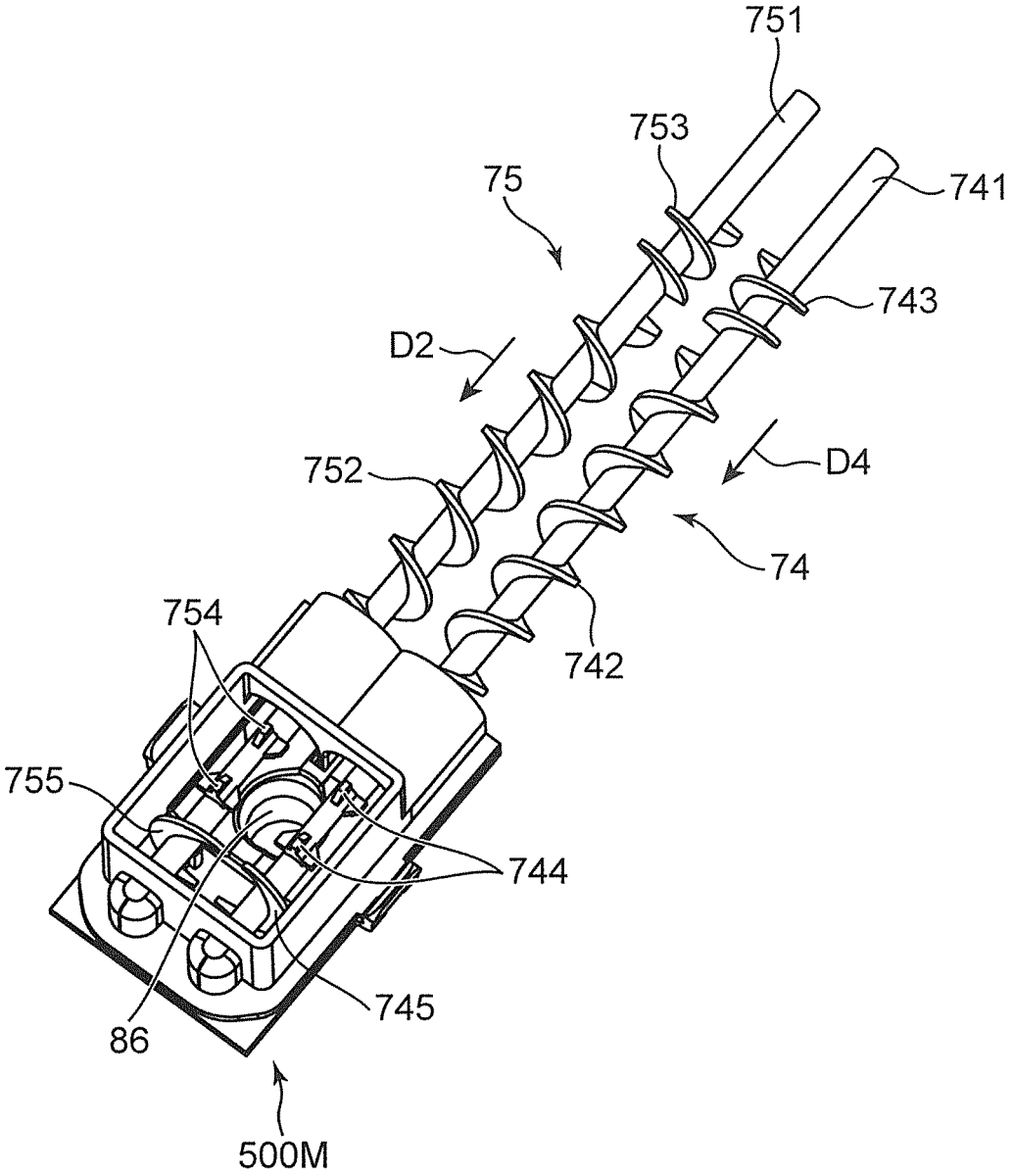
FIG. 9 is a perspective view of a joining portion of a toner replenishing unit according to a modified embodiment of the present disclosure.
Figure 10:
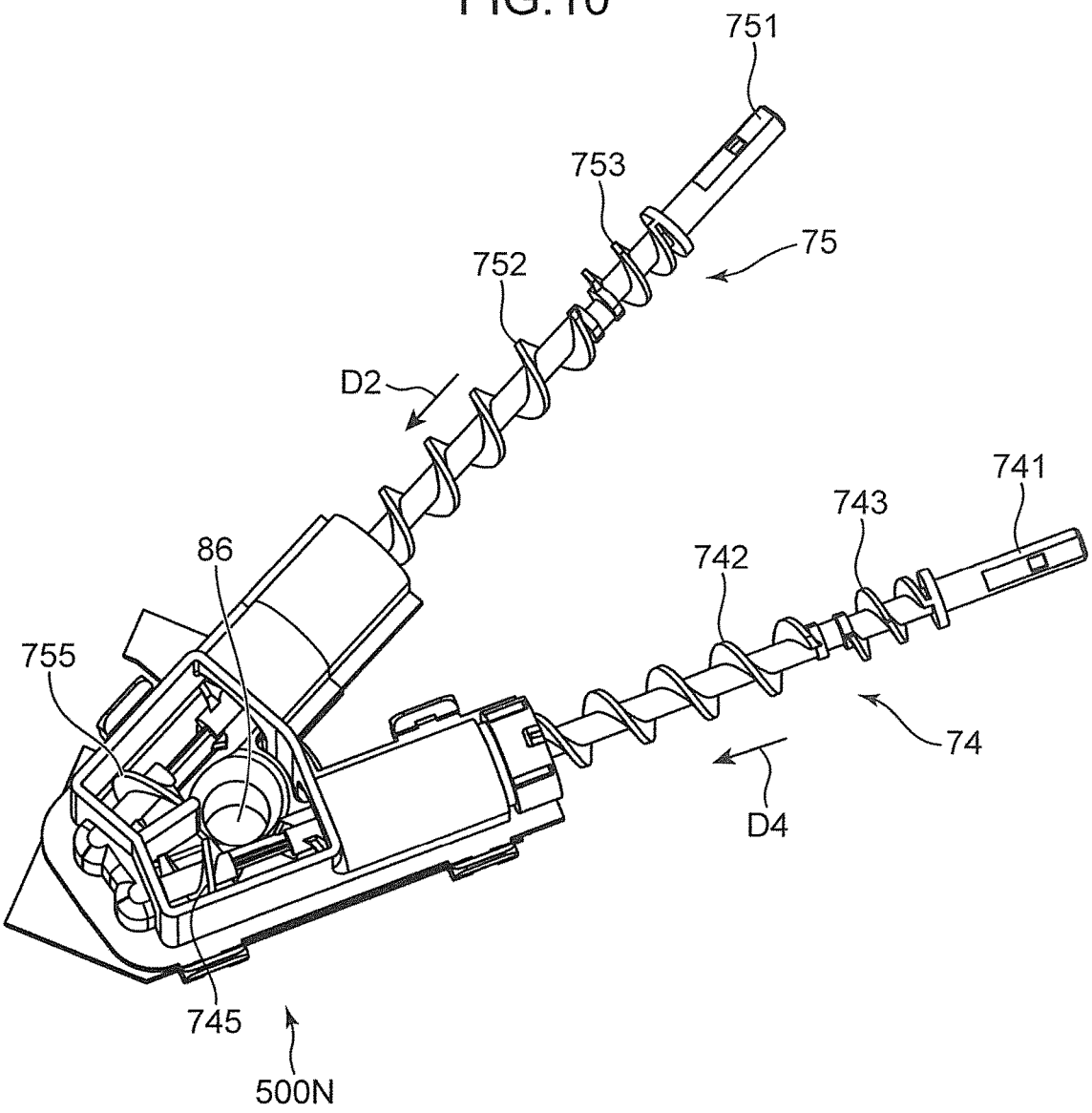
FIG. 10 is a perspective view of the joining portion of the toner replenishing unit according to the modified embodiment of the present disclosure.

(4) FIG. 9 and FIG. 10 are perspective views of joining portions 500 M and 500N of the toner replenishing unit according to a modified embodiment of the present disclosure, respectively. While the above embodiment has been described with respect to a mode in which the joining portion 500 has the third transport screw 85, the present disclosure is not limited thereto. As shown in FIG. 9 and FIG. 10, the joining portions 500 M and 500N internally receive toners transported by the first transport screw 74 and the second transport screw 75, and allow the toners to flow from a dropping port 86 directly into the third vertical transport portion 65.

Directions in which the first transport screw 74 and the second transport screw 75 transport toners may be the same (parallel) as shown in FIG. 9, or may be different from each other as shown in FIG. 10. As shown in FIG. 10, arranging the first transport screw 74 and the second transport screw 75 so as to form a V-shape enables the dropping port 86 to be arranged between the screws.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming device comprising:

a photosensitive drum rotated around a predetermined axis and having a circumference surface which allows an electrostatic latent image to be formed thereon and carries a toner image according to the electrostatic latent image;

a developing device which supplies a toner to the photosensitive drum to make the electrostatic latent image appear as the toner image;

a first toner container capable of storing a toner therein and discharging the toner;

a second toner container capable of storing a toner therein and discharging the toner;

a first vertical transport portion which guides a toner discharged from the first toner container downward along a vertical direction;

a second vertical transport portion which guides a toner discharged from the second toner container downward along the vertical direction;

a first horizontal transport portion which communicates with a lower end portion of the first vertical transport portion and guides a toner flowing in from the first vertical transport portion in a first direction along a horizontal direction;

a second horizontal transport portion which communicates with a lower end portion of the second vertical transport portion and guides a toner flowing in from the second vertical transport portion in a second direction along the horizontal direction;

a first transport member rotatably arranged in the first horizontal transport portion to transport a toner in the first direction;

a second transport member rotatably arranged in the second horizontal transport portion to transport a toner in the second direction;

a transport member drive portion which generates a drive force for causing the first transport member and the second transport member to rotate;

a container drive portion which generates a drive force for discharging a toner from the first toner container and the second toner container;

a joining portion which communicates with a downstream side part of the first horizontal transport portion in the first direction and a downstream side part of the second horizontal transport portion in the second direction to internally receive toners transported by the first transport member and the second transport member;

a first detection sensor arranged in the first vertical transport portion to detect presence/absence of a toner in the first vertical transport portion;

a second detection sensor arranged in the second vertical transport portion to detect presence/absence of a toner in the second vertical transport portion;

a drive controller which controls the transport member drive portion and the container drive portion, the drive controller switching between a first replenishment state of replenishing a toner from the first toner container to the developing device in response to a toner replenishment request from the developing device and a second replenishment state of replenishing a toner from the second toner container to the developing device in response to a toner replenishment request from the developing device and controlling the container drive portion according to toner absence information in the first vertical transport portion, the toner absence information being detected by the first detection sensor in the first replenishment state, thus discharging a toner from the first toner container to the first vertical transport portion and causing the first transport member to rotate in response to the replenishment request, and controlling the container drive portion according to toner absence information in the second vertical transport portion, the toner absence information being detected by the second detection sensor in the second replenishment state, thus discharging a toner from the second toner container to the second vertical transport portion and causing the second transport member to rotate in response to the replenishment request;

a count portion which accumulates rotation time of each of the first transport member and the second transport member; and a consumption amount calculation portion which calculates a consumption amount of a toner in each of the first toner container and the second toner container by calculating a flow rate of each toner flowing through the first horizontal transport portion and the second horizontal transport portion according to the rotation time accumulated by the count portion.

2. The image forming device according to claim 1, wherein the transport member drive portion includes:

a motor rotatable in a first rotation direction and a second rotation direction reverse to the first rotation direction;

a first transmission member interposed between the motor and the first transport member to allow the first transport member to rotate when the motor is rotated in the first rotation direction, and regulate rotation of the first transport member when the motor is rotated in the second rotation direction; and a second transmission member interposed between the motor and the second transport member to allow the second transport member to rotate when the motor is rotated in the second rotation direction, and regulate rotation of the second transport member when the motor is rotated in the first rotation direction.

3. The image forming device according to claim 1, wherein the joining portion includes:

a third vertical transport portion which is arranged below the first horizontal transport portion and the second horizontal transport portion and between the first horizontal transport portion and the second horizontal transport portion when viewed along the first direction, and transports a toner downward along the vertical direction until the toner reaches the developing device;

a third transport member which causes a toner received from the first horizontal transport portion to flow into the third vertical transport portion while transporting the toner in a third direction along the horizontal direction; and a fourth transport member which causes a toner received from the second horizontal transport portion to flow into the third vertical transport portion while transporting the toner in a fourth direction reverse to the third direction along the horizontal direction.

4. The image forming device according to claim 3, wherein the joining portion further includes an inflow assisting member which assists a toner transported by the third transport member and the fourth transport member to flow into the third vertical transport portion.

* * * * *